US005156806A

United States Patent [19]

Sutula et al.

[11] Patent Number: 5,156,806

[45] Date of Patent: Oct. 20, 1992

[54] METAL ALLOY AND METHOD OF PREPARATION THEREOF

[75] Inventors: Raymond A. Sutula, Laurel; Frederick E. Wang, Silver Spring, both of Md.

[73] Assignee: The United States of America as represented by the Secretary of the Navy, Washington, D.C.

[21] Appl. No.: 575,543

[22] Filed: May 5, 1975

[51] Int. Cl.[5] ..... C22C 24/00; C22C 23/00; C22C 30/00

[52] U.S. Cl. ..... 420/400; 420/402; 420/580; 420/591; 148/538

[58] Field of Search ..... 75/134 A, 134 P, 168 R; 148/400, 422, 424, 538; 420/403, 414, 400, 402, 580, 591

[56] References Cited

U.S. PATENT DOCUMENTS

| | | | |
|---|---|---|---|
| 2,519,252 | 8/1950 | Jones et al. | 75/168 R |
| 2,961,359 | 11/1960 | Lillie et al. | 75/168 R |
| 3,164,464 | 1/1965 | Heath | 75/135 |
| 3,189,442 | 6/1965 | Frost et al. | 75/168 R |
| 3,333,956 | 8/1967 | Foerster | 75/168 R |
| 3,563,730 | 2/1971 | Bach et al. | 75/134 A |

*Primary Examiner*—Donald P. Walsh
*Assistant Examiner*—Daniel Jenkins
*Attorney, Agent, or Firm*—Kenneth E. Walden; Roger D. Johnson

[57] ABSTRACT

Ternary metallic alloys of the formula $Li_xB_yMg_z$ wherein $0.05 \leqq x \leqq 0.90$, $0.05 \leqq y \leqq 0.90$, $0.05 \leqq z \leqq 0.90$, and $x+y+z=1$ and a method of preparing them. These alloys find use in areas where superlight weight, high specific strength (strength/weight ratio) and oxidation resistance are required.

15 Claims, 1 Drawing Sheet

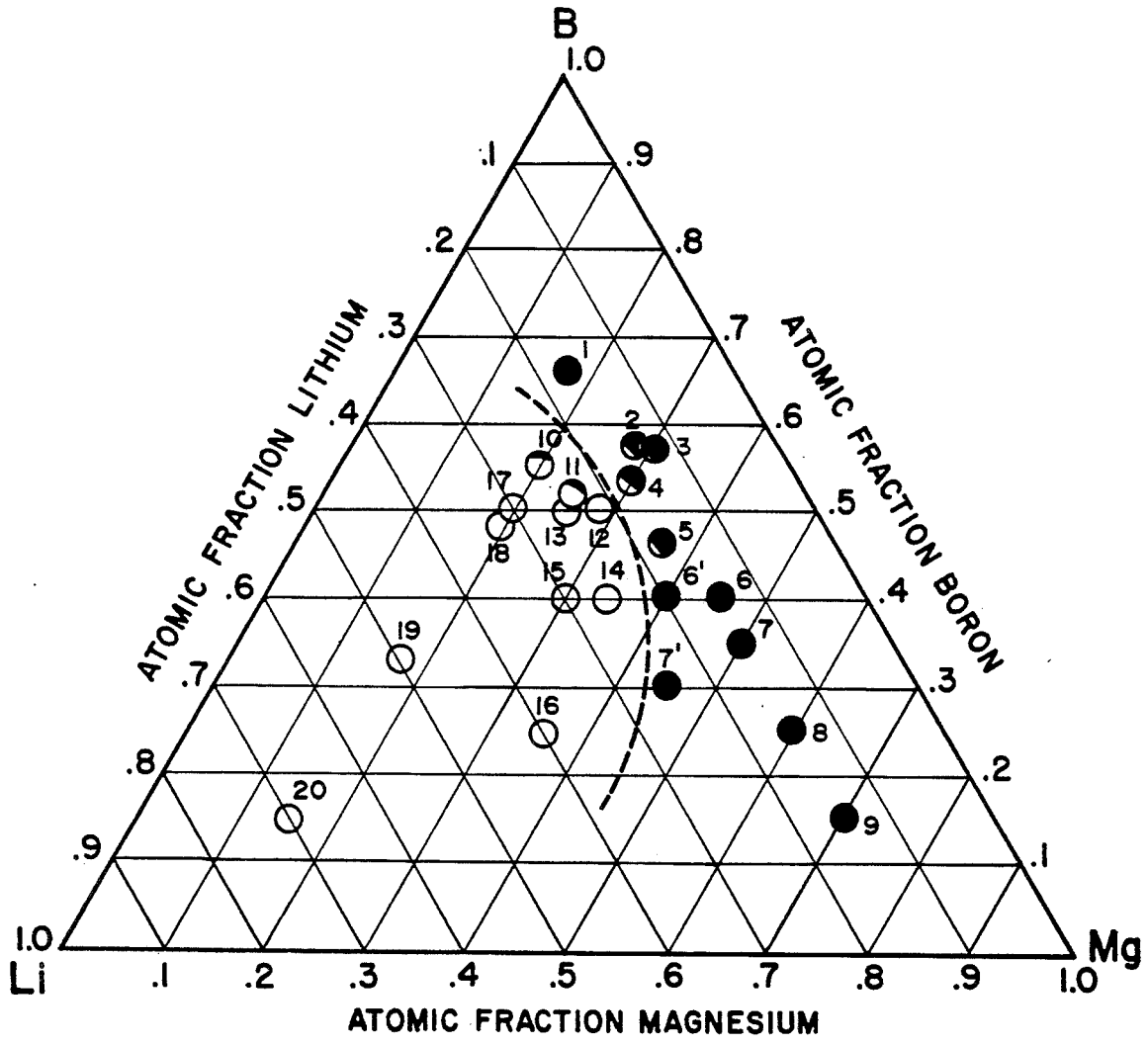
B
1.0
.1
.9
.2
.8
.3
.7
.4
.6
.5
.5
.6
.4
.7
.3
.8
.2
.9
.1
1.0
Li
.1
.2
.3
.4
.5
.6
.7
.8
.9
1.0
Mg
ATOMIC FRACTION LITHIUM
ATOMIC FRACTION BORON
ATOMIC FRACTION MAGNESIUM
1
2
3
4
5
6'
6
7
7'
8
9
10
11
12
13
14
15
16
17
18
19
20

METAL ALLOY AND METHOD OF PREPARATION THEREOF

BACKGROUND OF THE INVENTION

This invention generally relates to light weight metal alloys and more particularly to lithium-boron-magnesium ternary alloys.

For many uses as structural material it is desirable to have intermetallic alloys which are extremely light in weight, low in atomic number, ductile, malleable, and yet structurally strong and which have high melting points. Beryllium has been used because it meets many of these requirements. However, beryllium metal by nature is too brittle and toxic and is too expensive for general usage. Thus, a search has gone on for other materials which can take the place of beryllium and which do not have the same disadvantages as beryllium.

For instance, binary systems of boron-magnesium, lithium-magnesium, and lithium-boron have been studied for suitability as structural material to replace beryllium. Although the phase diagram of the boron-magnesium system has not been characterized, $MgB_2$, $MgB_4$, $MgB_6$ and $MgB_{12}$ do exist and their crystal structures have been identified. However, $MgB_2$ is undesirable as a structural material because of its high reactivity with air and water, and $MgB_4$, $MgB_6$, and $MgB_{12}$ are undesirable because they are too brittle to be useful as structural materials.

Freeth and Raynor [J. Inst. Metals, volume 82, page 575 (1953–54)] present a phase diagram for the lithium-magnesium binary system. This phase diagram shows no intermediate phases but rather wide primary solid solution ranges on both the lithium and the magnesium ends of the phase diagram. The alloys on the lithium rich side are undesirable because they are reactive with air and with water. On the other hand, the alloys on the magnesium rich side present a definite fire hazard, making them unsuitable for most applications.

Finally, attempts have been made to prepare metallic lithium-boron alloys. Thus, Markovskii and Kondraskev [Zh. Neorgen Khim., volume 2, pages 34–41 (1957)] and Secrist et al [U.S. Atomic Energy Comm, TID 17, 149 (1962)] and French Patent No. 1,461,878 have all attempted to prepare metallic lithium-boron alloys. In all of these cases, however, dark powders of undetermined composition were obtained. These powders were inorganic compounds which could not be utilized as structural materials because of the lack of the characteristics of metals. It is believed that all of these previous attempts to prepare metallic lithium-boron alloys resulted in the formation of inorganic compounds rather than true metal alloys.

Wang (F. E. ), in U.S. patent application Ser. No. 377,671, filed on Jul. 5, 1973, disclosed a process for the formation of true lithium-boron metallic alloys. Those alloys are light weight, ductile, malleable, and structurally strong. However, those lithium-boron alloys are readily susceptible to air oxidation, thus limiting their usefulness.

SUMMARY OF THE INVENTION

Accordingly, one object of this invention is to provide light weight metallic alloys with relatively high strengths.

Another object of this invention is to provide metallic alloys which are resistant to oxidation by air or water.

A further object of this invention is to provide metallic alloys which are ductile, malleable and easily fabricated.

Yet another object of this invention is to provide metallic alloys having a low average atomic number.

A still further object of this invention is to provide metallic alloys having relatively high melting (decomposition) temperatures.

Still another object of this invention is to provide metallic alloys which may be used as battery anodes.

These and other objects of this invention are accomplished by providing metallic alloys of the formula $Li_xB_yMg_z$ wherein $0.05 \leqq x = 0.90$, $0.05 \leqq y \leqq 0.90$, $0.05 \leqq z \leqq 0.90$, and $x+y+z=1$. These alloys are prepared by an unconventional 4 step process.

BRIEF DESCRIPTION OF THE DRAWING

The FIGURE represents some of the compositions and crystal structures of alloys of this invention which have been prepared.

DESCRIPTION OF THE PREFERRED EMBODIMENT

The ternary metallic alloys of this invention have the formula $Li_xB_yMg_z$ wherein $0.05 \leqq x \leqq 0.90$, $0.05 \leqq y \leqq 0.90$, and $0.05 \leqq z \leqq 0.90$; but preferably $0.15 \leqq x \leqq 0.70$, $0.15 \leqq y \leqq 0.70$, and $0.15 \leqq z \leqq 0.70$; wherein x is the atomic fraction of lithium, y is the atomic fraction of boron, and z is the atomic fraction of magnesium, with $x+y+z=1$. Note that Table I lists 22 alloys which were prepared to illustrate this invention and their properties.

The compositions of these alloys are plotted in the FIGURE. Open circles represent compositions having a cubic crystal structure, and filled circles represent compositions having hexagonal crystal structures. The circles that are, partly open and partly filled, represent compositions which have a mixture of cubic and hexagonal crystals. The relative proportion of cubic crystals to hexagonal crystal is represented by the ratio of open area of the circles to the filled area. Finally, the dotted line in the FIGURE demarcates those compositions which have predominately cubic crystal structures from those compositions which have predominately hexagonal crystal structures.

TABLE 1

ATOMIC %, CRYSTAL STRUCTURE, AND HARDNESS OF HIGH TEMPERATURE PHASE TERNARY ALLOYS

| Sample No. | Atomic % (Weight %) B | | Li | | Mg | | Crystal Structure | BHN (Hardness) | Machinability |
|---|---|---|---|---|---|---|---|---|---|
| 1 | 65 | (56.2) | 17.5 | (9.7) | 17.5 | (34.1) | Hexagonal | — | Poor |
| 2 | 58 | (44.6) | 14 | (6.9) | 28 | (48.5) | Hexagonal & cubic | 74 | Fair |
| 3 | 58 | (44.1) | 13 | (6.3) | 29 | (49.6) | " | 68 | Good |
| 4 | 53 | (40.8) | 18 | (8.9) | 29 | (50.3) | " | — | — |
| 5 | 47 | (34.3) | 18 | (8.4) | 35 | (57.3) | " | 79 | Fair |
| 6 | 40 | (26.5) | 15 | (6.4) | 45 | (67.1) | Hexagonal | 57 | Good |
| 6[1] | 40 | (28.0) | 20 | (9.0) | 40 | (63.0) | Hexagonal & cubic | 55 | Good |

TABLE 1-continued

ATOMIC %, CRYSTAL STRUCTURE, AND HARDNESS OF HIGH TEMPERATURE PHASE TERNARY ALLOYS

| Sample No. | Atomic % (Weight %) B | | Li | | Mg | | Crystal Structure | BHN (Hardness) | Machinability |
|---|---|---|---|---|---|---|---|---|---|
| 7 | 35 | (22.3) | 15 | (6.1) | 50 | (71.6) | " | — | — |
| 7[1] | 30 | (20.4) | 25 | (10.9) | 45 | (68.7) | " | — | — |
| 8 | 25 | (14.7) | 15 | (5.7) | 60 | (79.6) | " | — | — |
| 9 | 15 | (8.2) | 15 | (5.3) | 70 | (86.5) | " | — | — |
| 10 | 55 | (47.4) | 25 | (13.8) | 20 | (38.8) | Cubic | 37 | Poor |
| 11 | 52 | (42.8) | 24 | (12.7) | 24 | (44.5) | " | — | — |
| 12 | 50 | (39.3) | 22 | (11.1) | 28 | (49.6) | " | 51 | Good |
| 13 | 50 | (40.9) | 25 | (13.1) | 25 | (46.0) | " | 40 | Good |
| 14 | 40 | (30.4) | 27 | (13.2) | 33 | (56.4) | " | 53 | Good |
| 15 | 40 | (31.6) | 30 | (15.2) | 30 | (53.2) | " | 50 | — |
| 16 | 25 | (19.3) | 40 | (19.9) | 35 | (60.8) | " | — | — |
| 17 | 50 | (43.8) | 30 | (16.8) | 20 | (39.4) | " | — | — |
| 18 | 48 | (42.3) | 32 | (18.1) | 20 | (39.6) | " | 74 | Fair |
| 19 | 33 | (31.9) | 50 | (31.1) | 17 | (37.0) | " | — | Good |
| 20 | 15 | (16.0) | 70 | (48.0) | 15 | (36.0) | " | — | — |

While all of the alloys of this invention possess the desired properties of light weight, ductility, malleability, high strength and resistance to air oxidation, the composition may be selected to emphasize one or more of these properties. For example, increasing the content of boron increases the hardness of the alloys. In contradistinction, a higher lithium content results in an alloy which is more ductile, malleable and less brittle. On the other hand, increasing the magnesium content increases the resistance to oxidation by air or water.

It is clear that each constituent (lithium, boron, magnesium) must be at least 0.05 atomic fraction (or no more than 0.90 atomic fraction) of the alloy formed. For if an element falls less than 0.05 (or above 0.90) atomic fraction, the alloy is essentially a binary system and suffers the drawbacks as described in the background of the invention. Alloys containing an atomic percent fraction of at least 0.15 of each of the elements (lithium, boron, magnesium) are preferred because of their more balanced properties.

The alloys of the present invention are prepared by the following steps in order:

(1) Melting lithium metal (M.P. 182° C.).

(2) Dissolving magnesium in the molten lithium to form lithium-magnesium solution.

L(3) Dissolving crystalline boron into the molten lithium-magnesium solution to form the lithium-boron-magnesium solution. If the solution is cooled down at this point it will solidify into a lower temperature phase lithium-boron-magnesium alloy. It is preferred, however, to add the following step after step 3:

(4) Raising the temperature of the molten lithium-boron-magnesium solution until the solution solidifies. This results in the formation of a high temperature phase alloy. Because of the reactivity of lithium with oxygen and water all of these steps must be carried out in an inert atmosphere (e.g. dry neon, argon or helium).

Steps 2 and 3 are performed in temperature range of from about 250° C. to about 500° C. when the atomic fraction of lithium used is greater than or equal to the atomic fraction of magnesium used (i.e. $x/z \geqq 1$); however, steps 2 and 3 are performed in the temperature range of from about 700° C. to about 850° C. when the atomic fraction of the lithium used is less than the atomic fraction of the magnesium used (i.e. $x/z < 1$). When the atomic fraction of lithium is greater than or equal to the atomic fraction of magnesium ($x/z \geqq 1$), the temperature is kept below 500° C. until the magnesium and boron have been completely dissolved into the molten lithium. As example 1 shows, it is possible to form the pure ternary alloys containing an atomic fraction of lithium greater than or equal to that of magnesium by dissolving boron and magnesium into molten lithium in any order at temperatures above 500° C. However, there is a risk of binary lithium-boron alloys or lithium borides forming if this is done. Because of the limited solubility of solid magnesium in molten lithium, when the atomic fraction of lithium used is less than the atomic fraction of magnesium used ($x/z < 1$), to form the ternary alloy, the magnesium is added to the lithium at a temperature above the melting point of magnesium (651° C.). The preferred range is from about 700° C. to 850° C. At these temperatures the magnesium must be totally dissolved in the lithium before any boron is added; otherwise inorganic lithium boride compounds will be formed.

Crystalline boron is preferred over amorphous boron because invariably amorphous boron has an oxide coating which prevents or at least retards the reaction between lithium and boron. As a result, the amorphous boron either fails to dissolve in the molten lithium-magnesium solution or only dissolves with great difficulty. However, amorphous boron may be used in this invention if boron oxide content in the amorphous boron is kept at less than 0.2 weight percent.

After the boron has completely dissolved in the lithium-magnesium molten solution to form a lithium-boron-magnesium solution (i.e. after the completion of step 3), the temperature of the solution can be lowered to form a low temperature phase solid lithium-boron-magnesium ternary alloy. The solidification temperature will be the melting point of the alloy formed. Although these low temperature phase alloys have relatively low melting points, these alloys do possess the desired properties of light weight, high specific strength, good ductility and malleability, and resistance to oxidation by air or water. Therefore, these low temperature phase alloys make good materials for structures which are not exposed to high temperatures.

It is preferred, however; to raise the temperature of the molten lithium-boron-magnesium solution until the solution solidifies as a high temperature phase alloy. Note that the high temperature phase lithium-boron-magnesium ternary alloys formed have melting points above 1200° C. as compared to less than 651° C. for the low temperature phase alloys. It is believed that the high temperature phase alloys are atomically-ordered while the low temperature phase alloys are atomically-disordered.

As the temperature of the molten lithium-boron-magnesium solution is raised, the solution becomes more viscous until finally it solidified at about 1000°-1100° C. into the high temperature phase ternary alloy. When the atomic fraction of lithium is greater than or equal to the atomic fraction of magnesium ($x/z \geqq 1$) in the molten lithium-boron-magnesium solution, the viscosity of the solution slowly increases over a rather wide temperature range. As a result, it may be difficult to determine when the solidification is complete by ordinary observation. However, in this case an exotherm occurs when the solidification is complete; this exotherm may be detected by ordinary differential thermal analysis techniques. In the case where the atomic fraction of lithium is less than the atomic fraction of magnesium in the molten lithium-boron-magnesium solution, it is doubtful whether any detectable exotherm occurs. However, the solution rapidly solidifies over a narrow temperature range and, therefore, the completion of the solidification can be determined by ordinary visual observation. In all of these cases, the formation of the solid lithium-boron-magnesium ternary alloy is completed before the temperature reaches about 1100° C.

An important feature of the low temperature phase alloys is that they may be melted to form the original homogenous molten lithium-boron-magnesium solutions, which can then be converted into the corresponding high temperature phase alloys. As a result, large batches of molten lithium-boron-magnesium solutions may be prepared and stored as ingots of the corresponding low temperature phase alloys. These ingots may later be remelted; poured into molds of the desired shapes, and then by raising the temperature be converted into the corresponding high temperature phase alloys.

One important embodiment of this invention is the formation of a lithium-boron-magnesium alloy wherein the boron is essentially all in the form of the boron 10 isotope. Because $B^{10}$ (boron 10 isotope), a stable non-radioactive isotope, has an unusually high thermal neutron absorption cross section of 3836 barns, the uniform distribution of $B^{10}$ as is achieved in this invention can provide excellent thermal neutron shielding characteristics. Moreover, the resulting high temperature phase alloys are light, ductile, malleable structurally strong and have disassociation (melting) temperatures of over 1200° C. As a result, the high temperature phase alloys of the present invention made from boron 10 make excellent shields against thermal neutron radiation in nuclear reactors.

The general nature of the invention having been set forth, the following examples are presented as specific illustrations thereof. It will be understood that the invention is not limited to these specific examples but is susceptible to various modifications that will be recognized by one of ordinary skill in the art.

EXAMPLE I

This experiment was carried out in an inert atmosphere of dry helium gas in a glovebox. 3.622 grams of lithium metal were placed in a zirconium crucible which was then placed in a furnace and heated to 300° C. 3.762 grams of crystalline boron were then added to the molten lithium. After the boron had completely dissolved in the lithium (at about 575° C.), 4.222 grams of magnesium metal chips were added to the lithium-boron molten solution. The mixture of lithium, boron, and magnesium was continuously stirred as the temperature was raised. The viscosity continues to increase until an exothermal reaction was observed at which time the alloy completely solidified. After the sample had cooled down to room temperature in the furnace, the lithium-boron-magnesium ternary alloy product was removed from the glovebox and machined. It was found that the alloy, whose composition was 50 atomic percent lithium, 33 atomic percent boron, and 17 atomic percent magnesium, did not react with air.

EXAMPLE II

This experiment was also carried out in an inert atmosphere of dry helium gas within a glove box. 1.62 grams of lithium metal were placed in a zirconium crucible which was then placed into a furnace and heated to 400° C. 11.34 grams of magnesium chips were then added to the molten lithium. After the magnesium had completely dissolved in the lithium (at about 600° C.), small quantities of crystalline boron were added until all of the boron (2.52 gm total) had been added. The mixture was heated and continuously stirred until the mixture solidified at 950° C. No visible exotherm occurred. After the sample had cooled down to room temperature in the furnace, the alloy was removed from the glove box and machined. This alloy, whose composition was 20 atomic percent lithium, 40 atomic percent boron, and 40 atomic percent magnesium, did not react with atmosphere air. The alloy had a density of 1.67 gms/cc.

EXAMPLE III

Another alloy, whose atomic composition was 14 percent lithium, 28 percent magnesium, and 57 percent boron, was prepared according to the method of experiment 2. This alloy did not show any signs of oxidation even when it was immersed in water.

Other alloys based on lithium, boron, and magnesium were prepared in which the atomic percentages of the constituents were varied (see table 1). Again as in Examples 1, 2, and 3, these alloys were found to be stable to air oxidation.

What is claimed as new and desired to be secured by Letters Patent of the United States is:

1. A metallic alloy of the formula $Li_xB_yMg_z$ wherein $0.05 \leqq x \leqq 0.90$, $0.05 \leqq y \leqq 0.90$, $0.05 \leqq z \leqq 0.90$, and $x+y+z=1$, wherein x is the atomic fraction of lithium, y is the atomic fraction of boron, and z is the atomic fraction of magnesium in the alloy.

2. The alloy of claim 1 wherein the alloy is a low temperature phase alloy.

3. The alloy of claim 1 wherein the alloy is a high temperature phase alloy.

4. The alloy of claim 1 wherein $0.15 \leqq x \leqq 0.70$, $0.15 \leqq y \leqq 0.70$, and $0.15 \leqq z \leqq 0.70$.

5. The alloy of claim 4 wherein the alloy is a low temperature phase alloy.

6. The alloy of claim 4 wherein the alloy is a high temperature phase alloy.

7. The alloy of claim 1 wherein the boron consists essentially of boron 10.

8. The alloy of claim 7 wherein the alloy is a low temperature phase alloy.

9. The alloy of claim 7 wherein the alloy is a high temperature phase alloy.

10. The alloy of claim 4 wherein the boron consists essentially of boron 10.

11. The alloy of claim 10 wherein the alloy is a low temperature phase alloy.

12. The alloy of claim 10 wherein the alloy is a high temperature phase alloy.

13. A method of preparing the alloy of claim 2 comprising the following steps in order:

(1) melting lithium;

(2) dissolving magnesium in the molten lithium to form a lithium-magnesium molten solution;

(3) dissolving boron in the lithium-magnesium molten solution to form a lithium-boron-magnesium molten solution; and then (4) cooling the lithium-boron-magnesium molten solution until it solidifies;

provided that steps (2) and (3) are performed in the temperature range of from about 250° C. to about 500° C. when the atomic fraction of lithium is greater than or equal to the atomic fraction of magnesium, but in the temperature range of from about 700° C. to about 850° C. when the atomic fraction of lithium is less than the atomic fraction of magnesium, and further provided that all of the steps are carried out in an inert atmosphere.

14. The method of claim 13 wherein $0.15 \leqq x \leqq 0.70$, $0.15 \leqq y \leqq 0.70$, and $0.15 \leqq z \leqq 0.70$.

15. A method of preparing the alloy of claim 3 comprising the following steps in order:

(1) melting lithium, (2) dissolving magnesium in the molten lithium to form a lithium-magnesium molten solution;

(3) dissolving boron in the lithium-magnesium molten solution to form a lithium-boron-magnesium molten solution; and then (4) raising the temperature of the molten lithium-boron-magnesium solution until the solution completely solidifies;

provided that steps (2) and (3) are performed in the temperature range of from about 250° C. to about 500° C. when the atomic fraction of lithium is greater than or equal to the atomic fraction of magnesium, but in the temperature range of from about 700° C. to about 850° C. when the atomic fraction of lithium is less than the atomic fraction of magnesium, and further provided that all of the steps are carried out in an inert atmosphere.

* * * * *